US011643896B2

(12) United States Patent
Nafa et al.

(10) Patent No.: US 11,643,896 B2
(45) Date of Patent: May 9, 2023

(54) REMOVING OBSTRUCTIONS IN A WELLBORE

(71) Applicant: Saudi Arabian Oil Company, Dhahran (SA)

(72) Inventors: Hamed M. Nafa, Dammam (SA); Majid D. Al-Hajjaji, Ras Tanura (SA); Ali Abdulwahed Al Qassab, Juaymah (SA)

(73) Assignee: Saudi Arabian Oil Company, Dhahran (SA)

( * ) Notice: Subject to any disclaimer, the term of this patent is extended or adjusted under 35 U.S.C. 154(b) by 84 days.

(21) Appl. No.: 17/160,945

(22) Filed: Jan. 28, 2021

(65) Prior Publication Data

US 2022/0235619 A1 Jul. 28, 2022

(51) Int. Cl.

| | |
|---|---|
| ***E21B 27/02*** | (2006.01) |
| ***E21B 34/14*** | (2006.01) |
| ***E21B 23/01*** | (2006.01) |
| ***E21B 23/14*** | (2006.01) |
| ***E21B 34/06*** | (2006.01) |

(52) U.S. Cl.

CPC ..... *E21B 27/02* (2013.01); *E21B 23/01* (2013.01); *E21B 23/14* (2013.01); *E21B 34/063* (2013.01); *E21B 34/14* (2013.01)

(58) Field of Classification Search

CPC ..... E21B 27/02; E21B 23/01; E21B 23/14; E21B 34/063; E21B 34/14

See application file for complete search history.

(56) References Cited

U.S. PATENT DOCUMENTS

| | | | | | |
|---|---|---|---|---|---|
| 1,561,327 | A | * | 11/1925 | Hedrick | E21B 27/00 166/178 |
| 1,875,583 | A | * | 9/1932 | Fox | E21B 23/01 166/299 |
| 2,232,688 | A | | 2/1941 | Alexander | |
| 2,808,888 | A | * | 10/1957 | Teplitz | E21B 27/02 166/162 |
| 2,918,125 | A | * | 12/1959 | Sweetman | E21B 29/02 148/201 |
| 3,077,933 | A | * | 2/1963 | Bigelow | E21B 23/01 166/217 |

(Continued)

FOREIGN PATENT DOCUMENTS

| | | |
|---|---|---|
| EP | 2192262 | 11/2012 |

*Primary Examiner* — Steven A MacDonald
(74) *Attorney, Agent, or Firm* — Fish & Richardson P.C.

(57) ABSTRACT

A wellbore assembly includes a cable configured to be disposed within a wellbore. The wellbore assembly also includes a housing attached to a downhole end of the cable. The housing defines a fluid outlet at a downhole end of the housing. The housing includes an anchor and a collapsible gate. The anchor engages a wall of the wellbore under increased tension in the cable, thereby anchoring the housing to the wellbore. The collapsible gate is disposed inside the housing between an uphole end of the housing and the fluid outlet. The housing temporarily stores a treatment fluid configured to treat an obstruction in the wellbore. The collapsible gate is configured to break, with the anchor engaged, under further tension applied by the cable, inside the housing to allow the treatment fluid to flow out of the housing through the fluid outlet toward the obstruction.

14 Claims, 6 Drawing Sheets

(56) References Cited

U.S. PATENT DOCUMENTS

| | | | | |
|---|---|---|---|---|
| 3,872,925 | A * | 3/1975 | Owen | E21B 33/134 166/123 |
| 4,125,161 | A * | 11/1978 | Chammas | E21B 23/04 166/212 |
| 4,640,354 | A * | 2/1987 | Boisson | E21B 27/02 166/162 |
| 6,651,747 | B2 * | 11/2003 | Chen | E21B 47/12 166/212 |
| 6,691,781 | B2 | 2/2004 | Grant et al. | |
| 7,152,682 | B2 | 12/2006 | Hopper | |
| 8,361,938 | B1 | 1/2013 | Creasey | |
| 9,187,977 | B2 | 11/2015 | Alvarez et al. | |
| 2011/0198099 | A1 * | 8/2011 | Zierolf | E21B 23/01 166/382 |
| 2012/0234560 | A1 * | 9/2012 | Ezell | E21B 23/04 166/382 |
| 2014/0318782 | A1 | 10/2014 | Bourque | |
| 2016/0273289 | A1 * | 9/2016 | Moyes | E21B 23/06 |
| 2017/0175471 | A1 * | 6/2017 | Boleyn, Jr. | E21B 27/02 |
| 2018/0202269 | A1 * | 7/2018 | Wensrich | E21B 34/16 |
| 2021/0372217 | A1 * | 12/2021 | Lende | E21B 27/02 |

* cited by examiner

REMOVING OBSTRUCTIONS IN A WELLBORE

FIELD OF THE DISCLOSURE

This disclosure relates to wellbores, in particular, to wellbore tools.

BACKGROUND OF THE DISCLOSURE

During drilling or production operations, wellbore components or equipment can become stuck in the wellbore due to undesirable circumstances such as differential pressures, equipment failure, or junk piling up. To release the wellbore component, a fishing operation can be performed or solvents can be used to treat the component. Methods and equipment for releasing stuck components are sought.

SUMMARY

Implementations of the present disclosure include a wellbore assembly that includes a cable configured to be disposed within a wellbore. The wellbore assembly also includes a housing attached to a downhole end of the cable. The housing defines a fluid outlet at a downhole end of the housing. The housing includes an anchor and a collapsible gate. The anchor is coupled to a wall of the housing. The anchor engages a wall of the wellbore under increased tension in the cable, thereby anchoring the housing to the wellbore. The collapsible gate is disposed inside the housing between an uphole end of the housing and the fluid outlet. The housing includes an interior volume defined between the uphole end and the collapsible gate. The housing temporarily stores a treatment fluid configured to treat an obstruction in the wellbore. The collapsible gate is configured to break, with the anchor engaged, under further tension applied by the cable, inside the housing to allow the treatment fluid to flow out of the housing through the fluid outlet toward the obstruction.

In some implementations, the housing includes a first housing portion attached to the anchor and a second housing portion movable with respect to and away from the first housing portion. The first housing portion engages the collapsible gate at a first section of the gate and is fixed, with the anchor set on the wellbore, against substantial movement along the wellbore. The second housing portion engages the collapsible gate at a second section of the gate. The second housing section moves, under tension by the cable, with respect to the collapsible gate, thereby breaking the collapsible gate under opposite forces applied at the first and second sections of the collapsible gate. In some implementations, the first housing portion includes an inwardly projecting shoulder configured to engage an edge of the collapsible gate and the second housing portion includes a pin configured to engage the second section of the gate.

In some implementations, the housing further includes a biasing member disposed inside the housing. The interior volume is defined between the biasing member and the collapsible gate. The biasing member urges, with the collapsible gate broken, the treatment fluid out of the housing through the fluid outlet toward the obstruction.

In some implementations, the housing includes a fish neck sub and a fluid chamber sub attached to a downhole end of the fish neck sub. The fish neck sub houses at least a portion of the biasing member and the fluid chamber houses at least a portion of the treatment fluid pressurized by the biasing member urging the treatment fluid toward the collapsible gate.

In some implementations, the housing includes an anchor sub coupled to a downhole end of the fluid chamber. The anchor sub includes the collapsible gate. The anchor sub includes a pin attached to the anchor. The anchor is movable, under a sudden increase of tension in the cable, about the shear pin to engage the wall of the wellbore. In some implementations, the pin is breakable under increased tension in the cable upon depositing the treatment fluid, thereby allowing the anchor to disengage the wall of the wellbore. In some implementations, the fluid chamber sub includes a first shoulder and the anchor sub includes a second shoulder configured to engage, with the collapsible gate broken, the first shoulder, thereby allowing the cable to pull the anchor sub to break the pin and allow the anchor to disengage the wall of the wellbore.

In some implementations, the biasing member includes at least one of: an extendable rubber element, a spring, or a piston attached to a plate configured to contact and urge the treatment fluid toward the fluid outlet. The extendable rubber element extends, with the collapsible gate broken, toward the fluid outlet to urge with the plate the treatment fluid out of the housing.

In some implementations, the fish neck sub includes a fish neck attached to the cable and a fluid port extending through a wall of the fish neck sub. The fluid port receives fluid configured to increase a pressure of the housing to a pressure above a pressure of the wellbore at or near the obstruction.

Implementations of the present disclosure also include a method of assembling a wellbore tool. The method includes obtaining a top sub and a bottom sub. The top sub includes a volume configured to store a treatment fluid and the bottom sub including a collapsible gate, an anchor configured to engage a wall of a wellbore, and a fluid outlet. The method also includes filling at least a portion of the volume of the top sub with the treatment fluid. The method also includes attaching the bottom sub to an end of the top sub such that the fluid is contained between the collapsible gate and an uphole end of the top sub. The method also includes engaging the top sub with the collapsible gate.

In some implementations, the top sub includes a threaded end and the bottom sub includes an outer sleeve including a threaded end and an inner sleeve movable with respect to the outer sleeve, and attaching the bottom sub to the top sub includes threadedly attaching the outer sleeve to the top sub such that the inner sleeve is movable with respect to the top sub and the outer sleeve.

In some implementations, the method further includes, after attaching the bottom sub to the top sub, pressurizing, through a fluid port of the top sub, the treatment fluid to a pressure above a pressure of a wellbore location at which the wellbore tool is to be deployed.

In some implementations, the top sub includes a biasing member disposed inside the top sub, such that the treatment fluid is contained between the collapsible gate and the biasing member with the top sub attached to the bottom sub. The biasing member urges, with the collapsible gate broken, the treatment fluid out the housing through the fluid outlet.

In some implementations, the top sub includes a fish neck sub including a fish neck, and a fluid chamber sub including an internal volume configured to store the treatment fluid. Obtaining the top sub includes attaching the fish neck sub to the fluid chamber sub, the fish neck sub configured to house at least a portion of the biasing member and the fluid chamber sub configured to house at least a portion of the treatment fluid.

In some implementations, engaging the top sub with the collapsible gate includes engaging, with a pin of the top sub, the collapsible gate such that movement of the top sub with respect to the bottom sub breaks the collapsible gate.

Implementations of the present disclosure also include a method of removing an obstruction in a wellbore. The method includes lowering, within a wellbore with a cable, a wellbore tool. The wellbore tool includes 1) a housing, 2) an anchor coupled to a wall of the housing, and 3) a gate disposed inside the housing between an uphole end of the housing and a fluid outlet of the housing. The housing includes an interior volume defined between the uphole end and the collapsible gate and is configured to temporarily store a treatment fluid configured to treat an obstruction in the wellbore and remove the obstruction. The method also includes anchoring, with the anchor, the housing to the wall of the wellbore. The method also includes breaking, by applying tension to the cable, the gate. The method also includes flowing the treatment fluid out of the housing through the fluid outlet toward the obstruction.

In some implementations, anchoring the housing includes pulling the cable from a surface of the wellbore, increasing a tension in the housing, and allowing the anchor to move about a pin to engage the wall of the housing.

In some implementations, breaking the gate with the cable applying tension to the housing includes pulling the cable to apply tension to the housing.

In some implementations, the method further includes disengaging, by applying further tension to the cable, the anchor from the well of the wellbore, wherein disengaging the anchor includes shearing off a pin attached to the anchor.

DETAILED DESCRIPTION OF THE DISCLOSURE

The present disclosure describes a wellbore assembly such as an acid dump bailer tool to dissolve junk in a wellbore (e.g., to remove junk and thereby release equipment stuck in the wellbore). The acid dump bailer tool carries acid and dumps the acid on the junk to dissolve the junk and thus improve wellbore operations or release stuck component from the wellbore. The tool is lowered by a cable and operated only by applying tension on the cable (e.g., pulling the cable up the wellbore). Applying tension on the cable anchors the tool and opens a fluid pathway of the tool to dump the acid on the stuck component.

Particular implementations of the subject matter described in this specification can be implemented so as to realize one or more of the following advantages. For example, the wellbore assembly of the present disclosure requires minimal or no training. Additionally, the wellbore assembly does not require heavy equipment such as pumps or coiled tubing to send acid to the stuck component.

Figure 1:
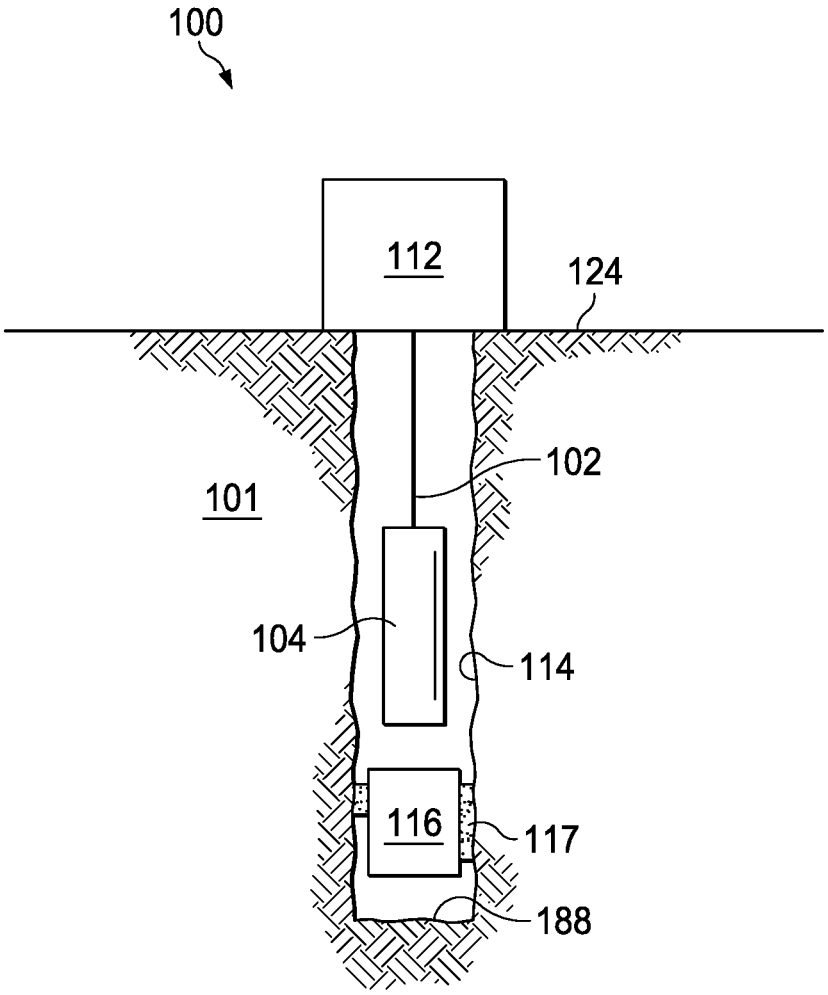
FIG. 1 is a schematic front view of a wellbore assembly according to implementations of the present disclosure.

FIG. 1 shows a wellbore assembly 100 (e.g., a wellbore dump assembly) that includes a cable 102 and a housing 104 (e.g., a chamber, a sub, or a wellbore tool) attached to a downhole end of the cable 102. The cable 102 is disposed within a wellbore 114. The wellbore 114 is formed in a geologic formation 101 that may include a hydrocarbon reservoir from which hydrocarbons can be extracted. The wellbore 114 extends from a surface 124 (e.g., a ground surface) to a downhole end 188 of the wellbore 114. The wellbore 114 can be a production wellbore or another type of wellbore.

The cable 102 (e.g., a wireline or a slickline) is attached to a surface equipment 112 (e.g., a truck, a crane, or a rig) and lowered by the surface equipment 112 within the wellbore 114. Lowering the cable 102 lowers the housing 104 within the wellbore 114 to position the housing 104 at a downhole location of the wellbore 114.

An obstruction in the wellbore such as a wellbore component 116 or equipment (e.g., downhole completion nipples, an electric submersible pump, a subsurface safety valve, or wellbore junk) that is stuck in the wellbore 114 can be treated by a treatment fluid contained inside the housing 104 to help release the component 116 from the wellbore For example, during production, a shaft of an electric submersible pump (ESP) can become stuck or jammed in the wellbore 114 due to accumulated impurities 117 such as debris, small fills of heavy oil, or for other reasons such as differential pressures. The wellbore assembly 100 can be lowered to a location near the stuck component 116 to dump a volume of the treatment solution (e.g., an acid, a solvent, or another chemical) to remove the impurities 117 and unstick the component 116 from the wellbore 114. In some implementations, the treatment solution can be used to clean the wellbore of junk or another obstructions for production or drilling operations.

Figure 2:
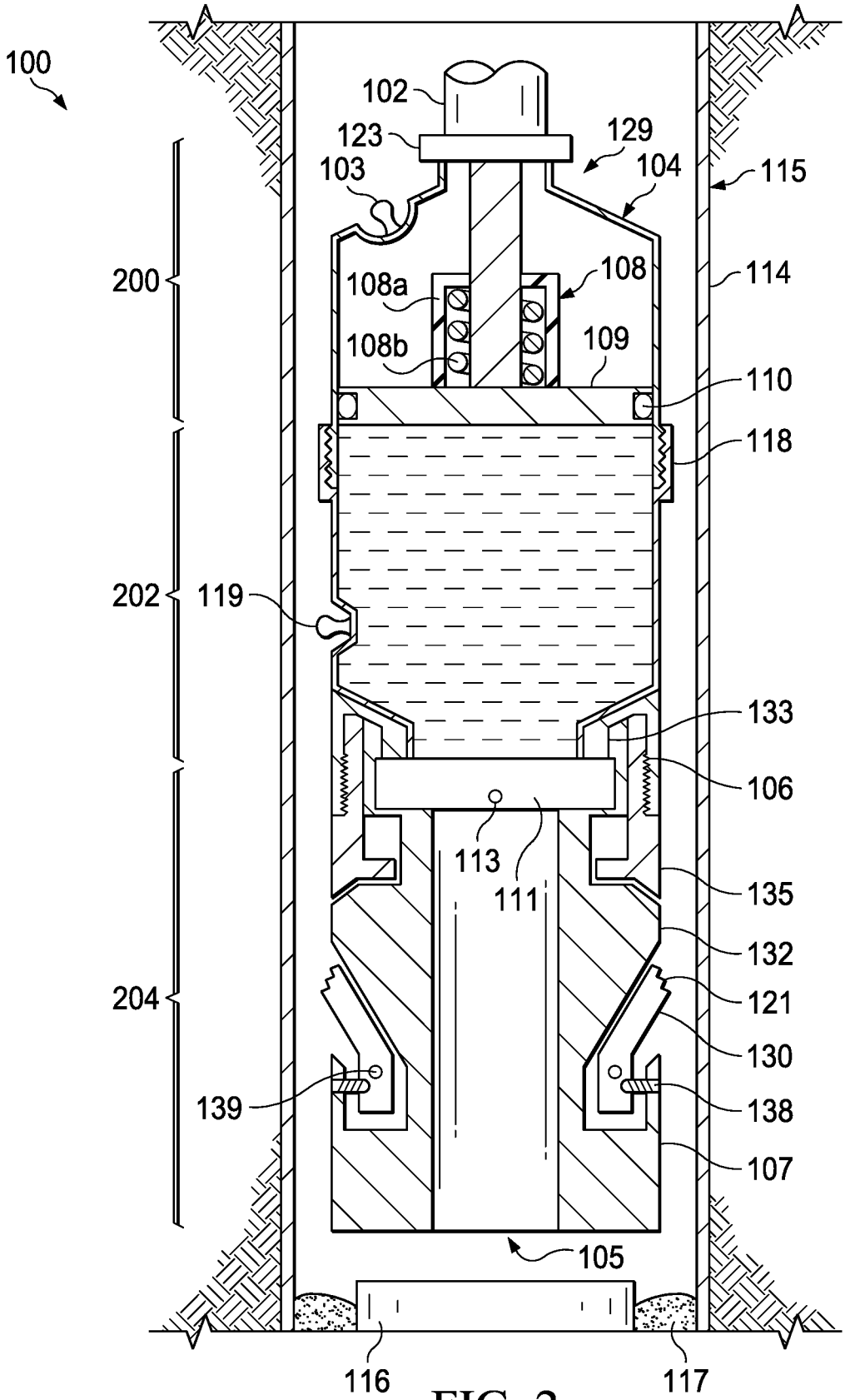
FIGS. 2-5 are front schematic views, cross-sectional, of sequential steps to remove or dissolve junk in a wellbore using a wellbore assembly according to implementations of the present disclosure.

As shown in FIG. 2, the housing 104 defines a fluid outlet 105 at a downhole end of the housing 104. As further described later in detail with respect to FIG. 4, the housing 104 allows the treatment fluid 'F' to flow out the housing through the fluid outlet 105 to reach the junk or stuck component 116.

The housing 104 includes one or more anchors 130 (e.g., slips) coupled to a wall 107 of the housing 104. Each anchor 130 has teeth 121 that engage a wall 115 of the wellbore 114 to anchor the housing 104 (e.g., engage the wellbore to prevent substantial movement of the housing) to the wellbore 114. The anchor 130 is set on the wall 115 of the wellbore 114 under increased tension in the cable 102. For example, with sudden upward movement of the housing 104 by pulling the cable 102, the anchors 130 expand or move (e.g., pivot about a pin 139) to engage the wall 115 of the wellbore 114. With the anchor 130 set on the wall 115 of the wellbore 114, the bottom portion of the wellbore assembly 100 is substantially fixed against movement with respect to the upper portion of the wellbore assembly.

The housing 104 also includes a biasing member 108 disposed inside the housing 104 near an uphole end 129 of the housing. The biasing member 108 is attached to a plate 109 that acts as a piston to urge the treatment fluid 'F' toward the outlet 105 of the housing 104. The biasing member 108 can be or include an expandable rubber element **108*a*, a spring 108*b*, a linear actuator, or a combination of the three. The plate 109 can include an O-ring 110 or another sealing element to form a seal (e.g., a fluid-tight seal) between both sides of the plate 109** (e.g., between an interior volume 'V' of the housing and a volume of a fish neck sub 200 where the biasing member 108 is stored).

The housing 104 also includes a collapsible gate 111 or disk disposed inside the housing 104 between the biasing member 108 and the fluid outlet 105. The gate 111 can be made, for example, of ceramic or a similar material that has low fracture toughness or plasticity. The housing 104 has an interior volume 'V' defined between the biasing member 108 and the collapsible gate 111 where the treatment fluid 'F' is stored. As further described in detail later with respect to FIG. 4, after the anchor 130 is set on the wellbore 114, at least a portion of the housing 104 moves with respect to the collapsible gate 111 to break the gate 111, allowing the fluid 'F' to flow out the housing 104 through the fluid outlet 105. For example, when the collapsible gate 111 is broken, the rubber element 108*a* extends toward the fluid outlet 105 to urge the treatment fluid out of the housing 104.

The housing 104 can include three subs: 1) a fish neck sub 200 or top sub, 2) a fluid chamber sub 202 or middle sub, and 3) an anchor sub 204 or bottom sub. The fluid chamber sub 202 is coupled to a downhole end of the fish neck sub 202 and the anchor sub 204 is coupled to a downhole end of the fluid chamber sub 202. To assemble the wellbore assembly 100, all three subs 200, 202, and 204 can be threadedly attached (e.g., attached at respective threaded ends to form threaded connections 106 and 118). The anchor sub 204 can include an outer sleeve 135 that is rotatably locked to the inner sleeve 132, but slidable (e.g., movable along a common axis) with respect to the inner sleeve 132. Such configuration allows the anchor sub 204 to be threadedly attached to the middle sub 202, while still allowing movement of the inner sleeve 132 with respect to the middle sub 202. Alternatively, the outer sleeve 135 can be rotatable with respect to the inner sleeve 132 and the outer sleeve can have an external tool interface that allows a tool to engage and rotate the outer sleeve 135 to attach the bottom sub 204 to the middle sub 202.

In some implementations, the bottom sub 204 can be referred to as the first portion (e.g., the anchorable or fixable portion) of the housing 104, and the top sub 200 and the middle sub 202 can be referred to as the second portion (e.g., the movable portion) of the housing 104. In some implementations, the top and middle sub can be one sub referred to as the top sub.

The fish neck sub 200 houses at least a portion of the biasing member 108 and the fluid chamber houses at least a portion of the treatment fluid 'F', which is pressurized by the retracted or compressed biasing member 108 urging the treatment fluid toward the collapsible gate 111. The fish neck sub 200 comprises a fish neck 123 attached to the cable 102 and a fluid port 103 extending through a wall of the fish neck sub 200. The fluid port 103 (e.g., a pressure equalizing port) receives pressurized fluid (e.g., a pressurized gas or oil) to urge the plate 109 toward the treatment fluid 'F', pressurizing the treatment fluid 'F'. This volume above the plate 109 can be filled with hydraulic oil to raise the pressure in such volume above the formation pressure downhole, to push, with the plate, the treatment fluid 'F' out of the housing 104.

The fluid chamber sub 202 includes a fluid port 119 that receives treatment fluid 'F' to fill in the volume 'V' or pressurize the fluid 'F'. The volume 'V' can store, for example, between 5 to 10 gallons of treatment fluid 'F'. The fluid chamber sub 202 can include an interior acid-resistant coat to protect the sub 202 from the treatment fluid. The fluid chamber sub 202 can be pressure rated to withstand a pressure of, for example, up to 5,000 psi. The fluid chamber sub 202 is attached to the anchor sub 204 through threaded connection 106.

The anchor sub 204 houses the collapsible gate 111, but the collapsible gate 111 is attached (or inserted) to a pin 113 of the fluid chamber sub 202. In some implementations, the anchor sub 204 can include a one-way valve (e.g., a gate valve) disposed between the collapsible gate 111 and the fluid outlet 105 of the housing 104 to prevent fluid from flowing back into the housing 104 after depositing the treatment fluid 'F'. However, the pressure inside the housing 104 will preferably be greater than the pressure in the wellbore 114, making the use of a one-way valve unnecessary. As further described in detail below with respect to FIG. 4, the anchor sub 204 allows, with the collapsible gate 111 broken, flow of the treatment fluid 'F' toward the fluid outlet 105 of the housing 104.

The anchor sub 204 includes a sleeve 132 that is attached, by fasteners 138 and shear-pins 139, to the anchor 130. The sleeve 132 has an inwardly projecting shoulder 133 (e.g., a radial shoulder) that engages the collapsible gate 111 to urge the ends of the gate in a downhole direction with respect to the pin 113 unto which the gate 111 is attached. With the anchors 130 set on the wall 115, further pull of top and middle subs 200 and 202 cause the pin 113 of the middle sub 202 to bend the gate 111 against the shoulder 133 of the anchor sub 204 to collapse the gate 111.

FIGS. 2-5 show sequential steps to dump the treatment fluid 'F' on the stuck component 116. FIG. 2 shows the housing 104 disposed at a downhole location of the wellbore 114, near the stuck component 116 or junk accumulated in the wellbore. Once the housing 104 is positioned in the desired location, the cable 102 is suddenly pulled upwards toward the surface of the wellbore to activate the anchor 130.

Figure 3:
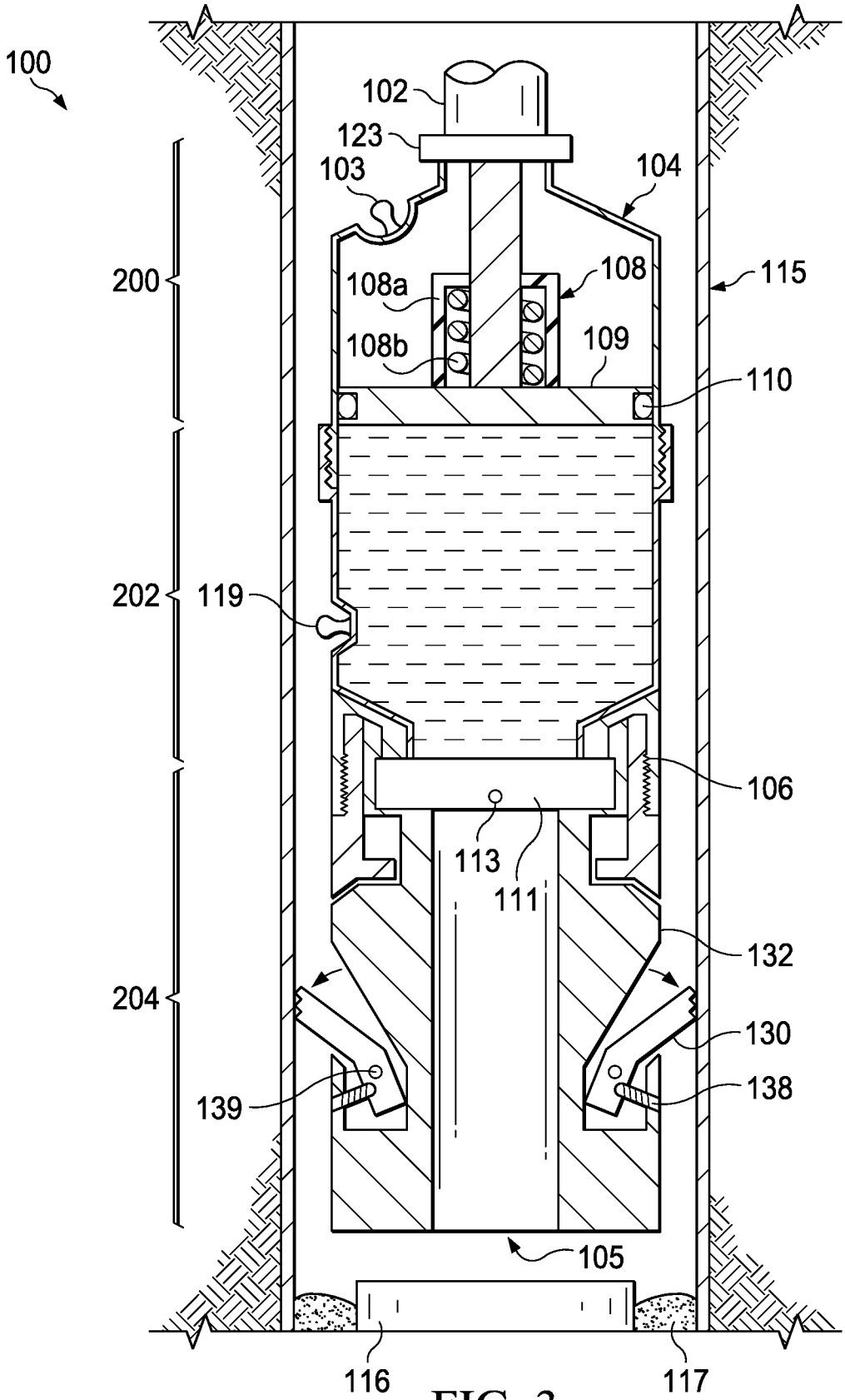

Referring now to FIG. 3, pulling the cable 102 in an uphole direction moves or activate the anchors 130 to prevent the anchor sub 130 from moving with respect to the fish neck sub 200 and the second sub 202. The anchors 130 can pivot or rotate about pin 139 to engage the wall 115 of the wellbore 114. The sleeve 132 of the bottom sub 204 is attached to the anchors 130 to prevent upward movement of the sleeve 132 when the anchors 130 are set on the wellbore 114.

Figure 4:
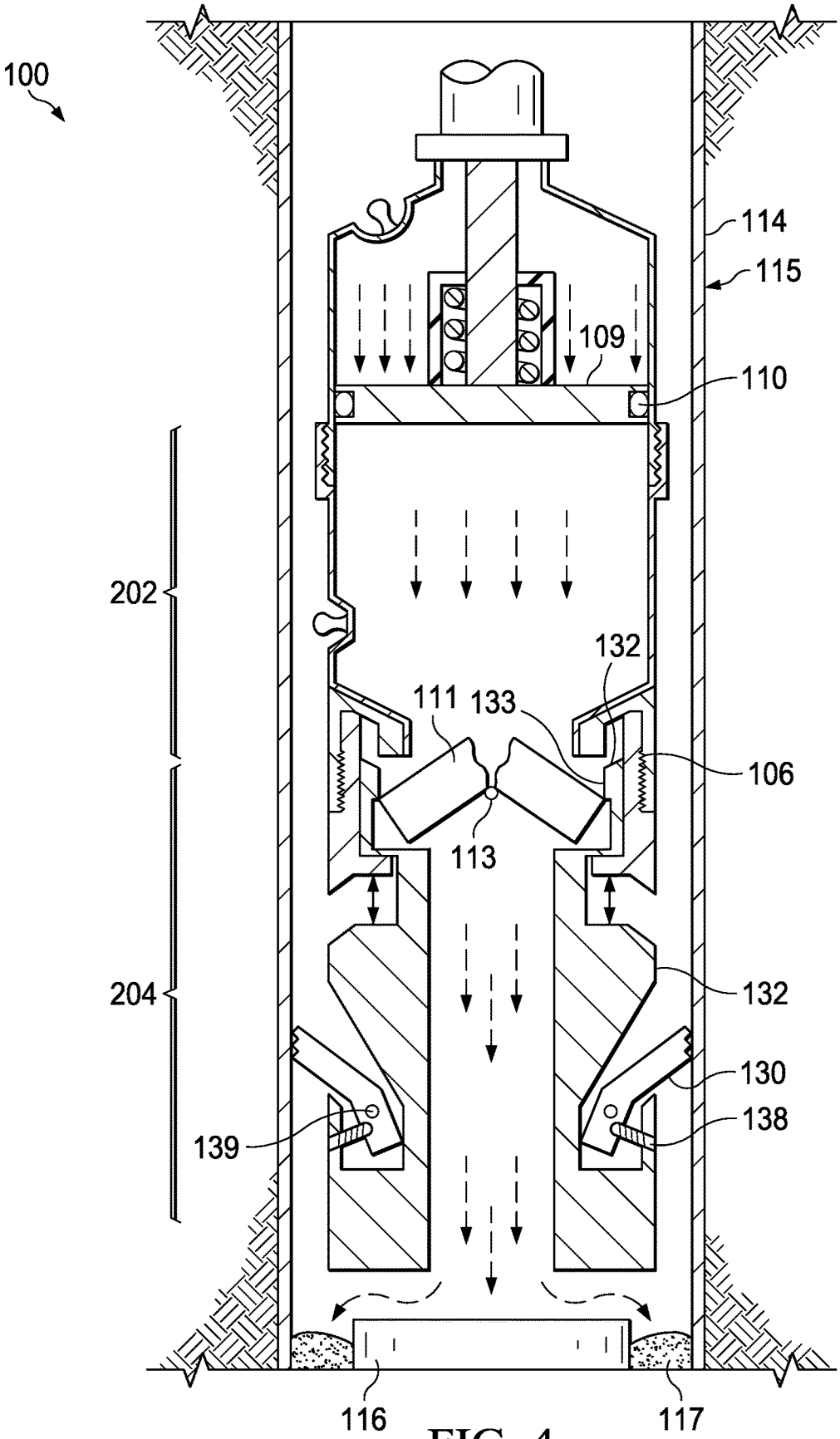

Referring now to FIG. 4, once the anchors 130 are set, the cable 102 is further pulled up to bend the gate between the pin 113 of the middle sub 202 and the shoulders of the bottom sub 204 until the collapsible gate 111 breaks. For example, the pin 113 is fixed to the middle sub 202 and the pin 113 engages the collapsible gate 111 as the middle sub 202 is pulled up by the cable 102. The middle sub 202 moves upward with respect to the bottom sub 204 because the bottom sub 204 is attached to the wellbore by the anchors 130.' The shoulder 133 of the bottom sub 204 prevents the collapsible gate 111 from moving upwards with the pin, thereby bending the gate 111 until the gate 111 collapses. For example, the gate 111 can shatter into pieces to allow the fluid 'F' to flow generally uninterruptedly out of the housing 104.

With the collapsible gate 111 broken, the biasing member 108 pushes the fluid 'F' out the housing 104 toward the suck component 116 and wellbore junk 117. The treatment fluid 'F' helps dissolve the junk 117 in the wellbore to clean the wellbore or unstuck the wellbore component 116.

Figure 5:
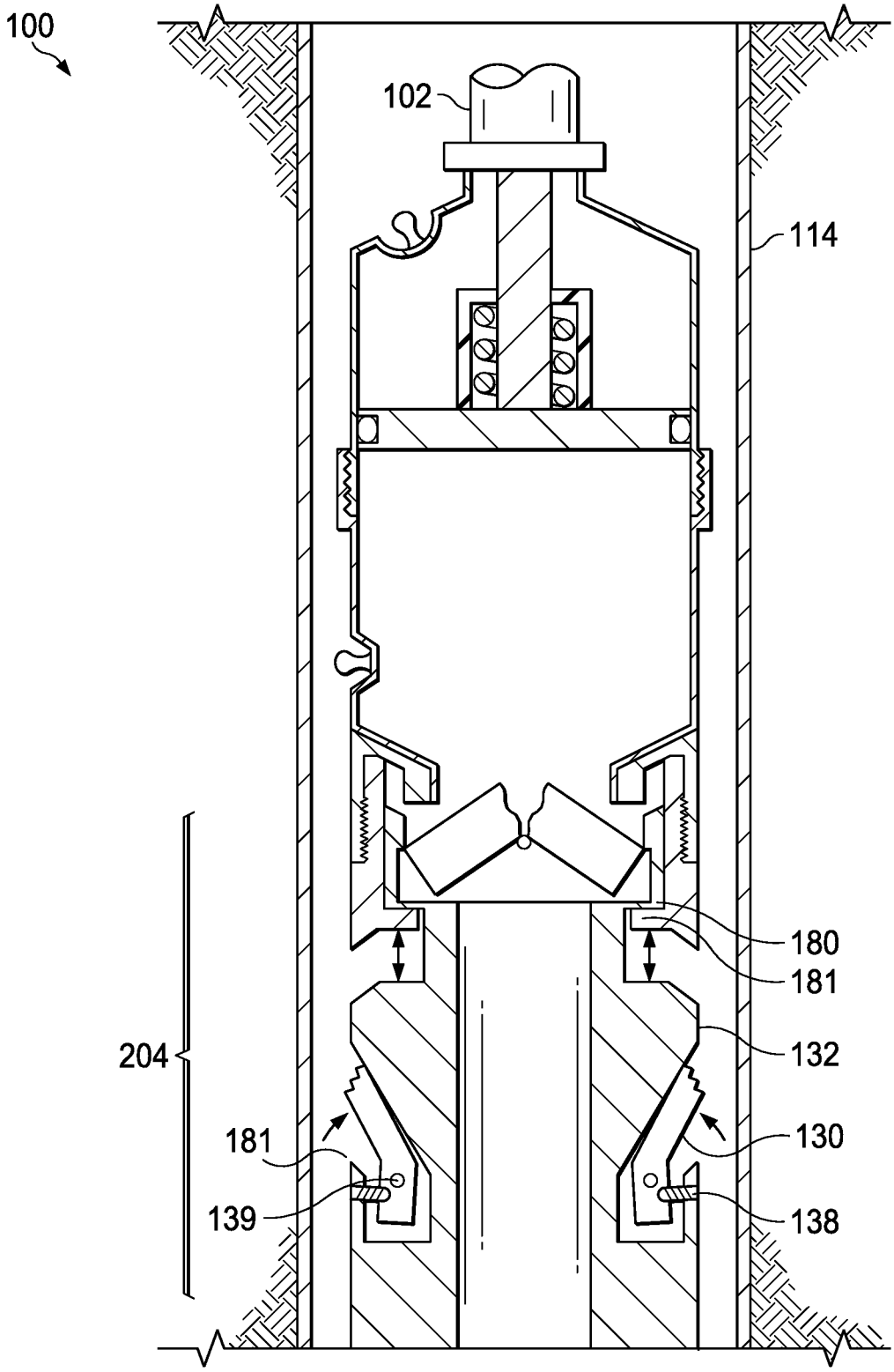

Referring now to FIG. 5, once the collapsible gate 111 has been broken and the fluid 'F' has been deposited in the area of interest, the wellbore assembly 100 can be retracted from the wellbore by further pulling or applying tension on the cable 102. For example, the sleeve 132 of the bottom sub 204 can engage, with an outwardly projecting shoulder 180 of the sleeve 132, an inwardly projecting shoulder 181 of the middle sub 202 such that pulling the middle sub 202 applies tension to the bottom sub 204. Pulling the bottom sub 204 causes the anchors 130 to apply shear stress on the pins 139 until the pins are sheared off. With the pins 139 broken, the anchors 130 retract into position to disengage the wellbore 114. With the anchors 130 disengaged, the wellbore assembly 100 can be retrieved from the wellbore 114 by pulling on the cable 102.

Figure 6:
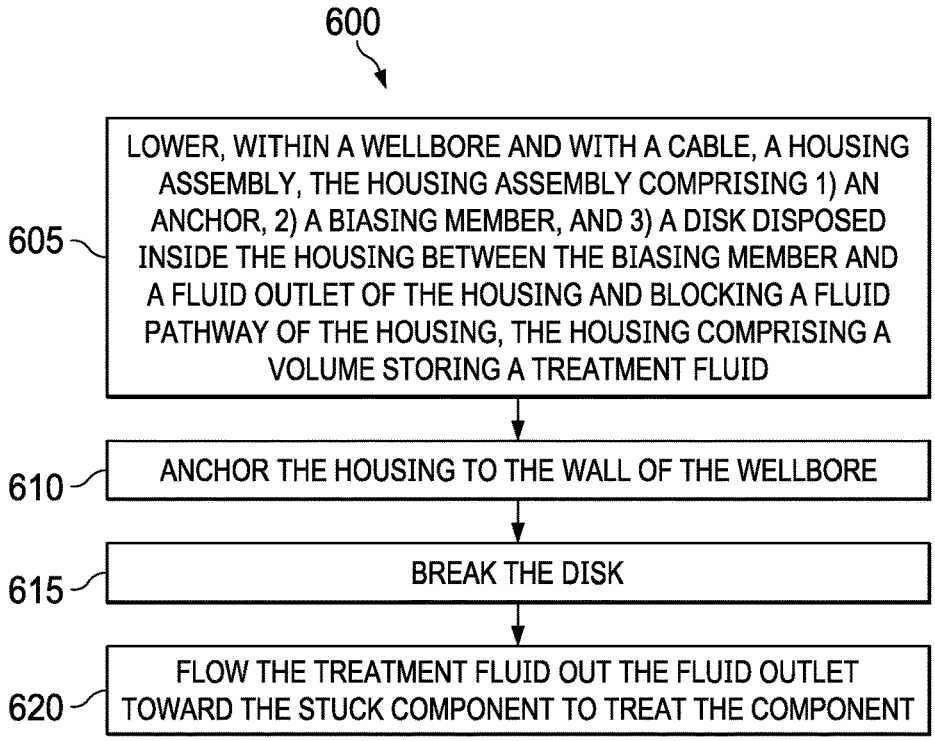
FIG. 6 is a flow chart of an example method of removing junk in a wellbore.

FIG. 6 shows a flow chart of an example method 600 of removing a wellbore obstruction. The method includes lowering, within a wellbore and with a cable, a housing assembly, the housing assembly comprising 1) an anchor coupled to a wall of the housing, 2) a biasing member disposed inside the housing, and 3) a disk disposed inside the housing between the biasing member and a fluid outlet of the housing and blocking a fluid pathway of the housing, the housing comprising a volume storing a treatment fluid (605). The method also includes anchoring the housing to the wall of the wellbore (610), breaking the disk (615), and flowing the treatment fluid out the fluid outlet toward the stuck component to treat the component (620).

Figure 7:
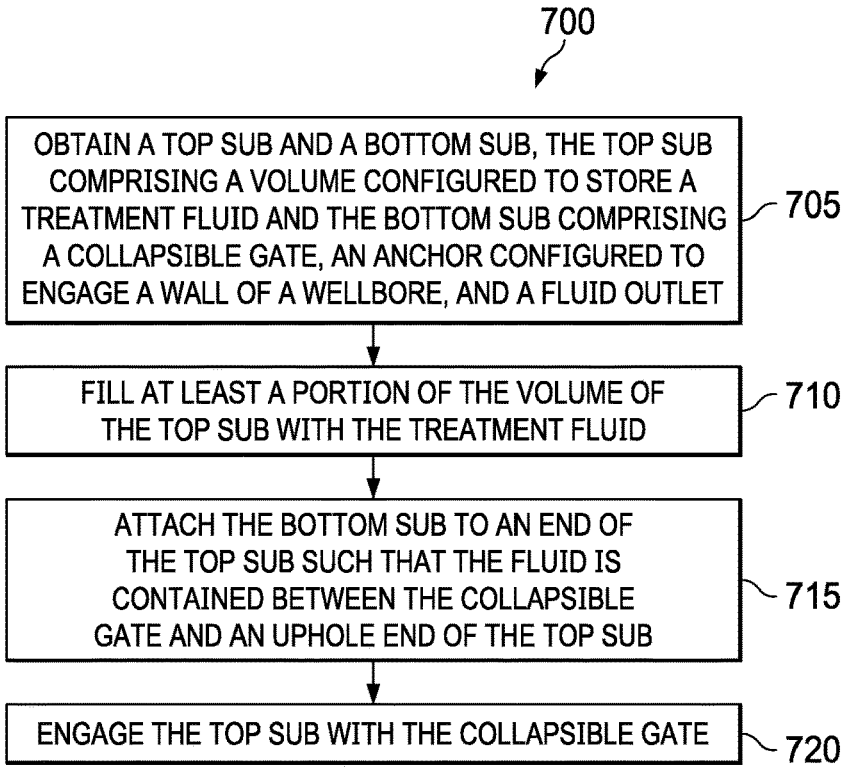
FIG. 7 is a flow chart of an example method of assembling a wellbore tool.

FIG. 7 shows a flow chart of an example method 700 of assembling a wellbore tool. The method includes obtaining a top sub and a bottom sub. The top sub includes a volume configured to store a treatment fluid and the bottom sub includes a collapsible gate, an anchor configured to engage a wall of a wellbore, and a fluid outlet (705). The method also includes filling at least a portion of the volume of the top sub with the treatment fluid (710). The method also includes attaching the bottom sub to an end of the top sub such that the fluid is contained between the collapsible gate and an uphole end of the top sub (715). The method also includes engaging the top sub with the collapsible gate (720).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A wellbore assembly, comprising:

a cable configured to be disposed within a wellbore; and a housing attached to a downhole end of the cable, the housing defining a fluid outlet at a downhole end of the housing, the housing comprising:

an anchor coupled to a wall of the housing, the anchor configured to engage a wall of the wellbore under increased tension in the cable, thereby anchoring the housing to the wellbore; and a collapsible gate disposed inside the housing between an uphole end of the housing and the fluid outlet, the collapsible gate configured to be engaged by a portion of the housing and comprising a first section that is prevented, with the housing anchored in the wellbore and the portion of the housing applying a force in an uphole direction to a second section of the collapsible gate, from substantially moving with respect to the portion of the housing, the housing comprising an interior volume defined between the uphole end and the collapsible gate and configured to temporarily store a treatment fluid configured to treat an obstruction in the wellbore, wherein the portion of the housing is configured to be moved uphole by the cable to engage the second section of the collapsible gate and break, with the anchor engaged and under further tension in the cable to move the second section of the collapsible gate uphole, the collapsible gate, thereby allowing the treatment fluid to flow out of the housing through the fluid outlet toward the obstruction.

2. The wellbore assembly of claim 1, wherein the portion of the housing comprises an upper housing portion and the housing further comprises a lower housing portion attached to the anchor, the upper housing portion movable with respect to and away from the lower housing portion, the lower housing portion engaging the collapsible gate at the first section of the gate and fixed, with the anchor set on the wellbore, against substantial movement along the wellbore, the upper housing portion engaging the collapsible gate at the second section of the gate and configured to move, under tension by the cable, with respect to the collapsible gate, thereby breaking the collapsible gate under opposite forces applied at the first and second sections of the collapsible gate.

3. The wellbore assembly of claim 2, wherein the lower housing portion comprises an inwardly projecting shoulder configured to engage an edge of the collapsible gate and the upper housing portion comprises a pin configured to engage the second section of the gate to break the gate.

4. The wellbore assembly of claim 1, wherein the housing further comprises a biasing member disposed inside the housing, the interior volume defined between the biasing member and the collapsible gate, the biasing member configured to urge, with the collapsible gate broken, the treatment fluid out the housing through the fluid outlet toward the obstruction.

5. The wellbore assembly of claim 4, wherein the housing comprises a fish neck sub and a fluid chamber sub attached to a downhole end of the fish neck sub, the fish neck sub housing at least a portion of the biasing member and the fluid chamber housing at least a portion of the treatment fluid pressurized by the biasing member urging the treatment fluid toward the collapsible gate.

6. The wellbore assembly of claim 5, wherein the housing comprises an anchor sub coupled to a downhole end of the fluid chamber sub and housing the collapsible gate, the anchor sub comprising a pin attached to the anchor, the anchor movable, under a sudden increase of tension in the cable, about the shear pin to engage the wall of the wellbore.

7. The wellbore assembly of claim 6, wherein the pin is breakable under increased tension in the cable upon depositing the treatment fluid, thereby allowing the anchor to disengage the wall of the wellbore.

8. The wellbore assembly of claim 6, wherein the fluid chamber sub comprises a first shoulder and the anchor sub comprises a second shoulder configured to engage, with the collapsible gate broken, the first shoulder, thereby allowing the cable to pull the anchor sub to break the pin and allow the anchor to disengage the wall of the wellbore.

9. The wellbore assembly of claim 5, wherein the biasing member comprises at least one of: an extendable rubber element, a spring, or a piston attached to a plate configured to contact and urge the treatment fluid toward the fluid outlet, the extendable rubber element configured to extend, with the collapsible gate broken, toward the fluid outlet to urge with the plate the treatment fluid out of the housing.

10. The wellbore assembly of claim 9, wherein the fish neck sub comprises a fish neck attached to the cable and a fluid port extending through a wall of the fish neck sub, the fluid port configured to receive fluid configured to increase a pressure of the housing to a pressure above a pressure of the wellbore at or near the obstruction.

11. A method, comprising:

lowering, within a wellbore and with a cable, a wellbore tool, the wellbore tool comprising 1) a housing, 2) an anchor coupled to a wall of the housing, and 3) a gate disposed inside the housing between an uphole end of the housing and a fluid outlet of the housing, the gate configured to be engaged by a portion of the housing, the housing comprising an interior volume defined between the uphole end and the collapsible gate and configured to temporarily store a treatment fluid configured to treat an obstruction in the wellbore and remove the obstruction, anchoring, with the anchor, the housing to the wall of the wellbore;

breaking, by applying tension to the cable, the gate, wherein breaking the gate comprises pulling, with a first section of the gate prevented from substantially moving with respect to the portion of the housing, the cable to move the portion of the housing uphole to push a second section of the gate uphole until the gate breaks; and directing the treatment fluid out of the housing through the fluid outlet toward the obstruction.

12. The method of claim 11, wherein anchoring the housing comprises pulling the cable from a surface of the wellbore, increasing a tension in the housing, and allowing the anchor to move about a pin to engage the wall of the housing.

13. The method of claim 11, wherein breaking the gate with the cable applying tension to the housing comprises pulling the cable.

14. The method of claim 11, further comprising disengaging, by applying further tension to the cable, the anchor from the well of the wellbore, wherein disengaging the anchor comprises shearing off a pin attached to the anchor.

* * * * *